US009079389B2

(12) United States Patent
Ohsawa

(10) Patent No.: US 9,079,389 B2
(45) Date of Patent: Jul. 14, 2015

(54) SHEET-FED PRINTING PRESS

(75) Inventor: Shin Ohsawa, Tsukuba (JP)

(73) Assignee: KOMORI CORPORATION, Tokyo (JP)

( * ) Notice: Subject to any disclaimer, the term of this patent is extended or adjusted under 35 U.S.C. 154(b) by 952 days.

(21) Appl. No.: 12/153,961

(22) Filed: May 28, 2008

(65) Prior Publication Data

US 2008/0295710 A1 Dec. 4, 2008

(30) Foreign Application Priority Data

May 31, 2007 (JP) ..... 2007-144592

(51) Int. Cl.

| | |
|---|---|
| ***B41F 19/02*** | (2006.01) |
| ***B41F 7/06*** | (2006.01) |
| ***B41F 13/00*** | (2006.01) |
| ***B41F 13/004*** | (2006.01) |
| ***B41F 16/00*** | (2006.01) |
| ***B41F 19/06*** | (2006.01) |
| ***B41F 23/04*** | (2006.01) |
| ***B41F 23/08*** | (2006.01) |
| ***B41F 33/16*** | (2006.01) |

(52) U.S. Cl.

CPC . *B41F 19/02* (2013.01); *B41F 7/06* (2013.01); *B41F 13/0008* (2013.01); *B41F 13/0045* (2013.01); *B41F 16/00* (2013.01); *B41F 19/062* (2013.01); *B41F 23/044* (2013.01); *B41F 23/0409* (2013.01); *B41F 23/0476* (2013.01); *B41F 23/08* (2013.01); *B41F 33/16* (2013.01); *B41P 2219/50* (2013.01)

(58) Field of Classification Search

CPC ..... B41F 23/0409; B41F 7/06; B41F 19/062; B41P 2219/50
USPC ..... 101/3.1, 5, 6, 23, 32
IPC ..... B41F 16/00, 19/06
See application file for complete search history.

(56) References Cited

U.S. PATENT DOCUMENTS

| | | | | |
|---|---|---|---|---|
| 5,671,678 | A | 9/1997 | Bolte et al. | |
| 5,983,793 | A | 11/1999 | Volz et al. | |
| 6,334,248 | B1 | 1/2002 | Gallagher | |
| 6,491,780 | B2 | 12/2002 | Gallagher | |
| 7,021,215 | B2 * | 4/2006 | Schneider et al. | 101/487 |
| 2005/0092196 | A1 | 5/2005 | Scholzig et al. | |

(Continued)

FOREIGN PATENT DOCUMENTS

| | | | |
|---|---|---|---|
| CN | 1229384 | A | 9/1999 |
| DE | 41 05 952 | A1 | 8/1992 |

(Continued)

OTHER PUBLICATIONS

Japanese Office Action issued in Japanese Patent Application No. 2007-144592 on Mar. 27, 2012.

(Continued)

*Primary Examiner* — Blake A Tankersley
*Assistant Examiner* — Marissa Ferguson Samreth
(74) *Attorney, Agent, or Firm* — Birch, Stewart, Kolasch & Birch, LLP

(57) ABSTRACT

A sheet-fed printing press is provided with a cold foil-transferring unit for transferring foil onto a paper sheet, a printing unit for performing printing on the paper sheet, and an embossing unit for giving an embossed finish to the paper sheet.

9 Claims, 6 Drawing Sheets

(56) References Cited

U.S. PATENT DOCUMENTS

| | | | | |
|---|---|---|---|---|
| 2007/0284047 | A1* | 12/2007 | Preisner et al. | 156/387 |
| 2010/0078121 | A1 | 4/2010 | Scholzig et al. | |

FOREIGN PATENT DOCUMENTS

| | | | |
|---|---|---|---|
| DE | 198 26 974 | A1 | 12/1999 |
| DE | 101 41 589 | A1 | 4/2002 |
| DE | 103 06 493 | A1 | 10/2003 |
| DE | 20 2004 010 796 | U1 | 9/2004 |
| DE | 20 2004 018 763 | U1 | 3/2005 |
| DE | 10 2005 011 697 | A1 | 11/2005 |
| DE | 20 2006 005 296 | U1 | 6/2006 |
| DE | 10 2005 027 815 | A1 | 12/2006 |
| EP | 0 819 521 | A2 | 1/1998 |
| EP | 0 834 398 | A1 | 4/1998 |
| EP | 1 700 692 | A2 | 9/2006 |
| EP | 1 700 695 | A2 | 9/2006 |
| EP | 1 717 031 | A2 | 11/2006 |
| EP | 1 839 860 | A2 | 10/2007 |
| JP | 04-070340 | A | 3/1992 |
| JP | 6-40141 | A | 2/1994 |
| JP | 10-006635 | A | 1/1998 |
| JP | 2005-132115 | A | 5/2005 |
| JP | 2006-224667 | A | 8/2006 |
| JP | 2006-305903 | A | 11/2006 |
| JP | 2007-276465 | A | 10/2007 |
| JP | 2007-532348 | A | 11/2007 |
| JP | 2007-532354 | A | 11/2007 |
| JP | 2010-514588 | A | 5/2010 |
| WO | WO 97/45266 | A1 | 12/1997 |
| WO | WO 01/88268 | A1 | 11/2001 |
| WO | WO 2005/049322 | A1 | 6/2005 |
| WO | WO 2005/100024 | A1 | 10/2005 |
| WO | WO 2005/100028 | A1 | 10/2005 |
| WO | WO 2005/102700 | A1 | 11/2005 |

OTHER PUBLICATIONS

Japanese Office Action issued Japanese Patent Application No. 2007-144592 on Aug. 7, 2012.

* cited by examiner

SHEET-FED PRINTING PRESS

BACKGROUND OF THE INVENTION

1. Field of the Invention

The present invention relates to a sheet-fed printing press that performs printing, foil transferring, and embossing on a sheet.

2. Description of the Related Art

In order to improve the value of printing products, the following procedure is sometimes used to create the effect of a highly elegant appearance on the printing products, for example. Firstly, metal foil is transferred onto a sheet, and then printing is performed with ink. After that, emboss process is performed on the portion with the foil being transferred thereon. The raised finish by the embossing and the brilliance of foil generate a synergistic effect on the appearance of the sheet.

When the above-described procedure is performed on a sheet, foil is firstly transferred onto the sheet by use of a foil transfer apparatus that is described, for example, in JP-A-2006-224667. Then, printing with ink and embossing are performed on the sheet by use of a printing press that is described, for example, in JP-A-2006-305903 (particularly, see paragraphs [0001] and [0062]).

The procedure described above, however, has the following problems. Specifically, both the foil transfer apparatus and the printing press must be provided to perform the transferring of the foil onto the sheet by use of the foil transfer apparatus, and then to perform the printing with ink and the embossing on the sheet by use of the above-described printing press. The installation of both the foil transfer apparatus and the printing press requires a space that is difficult to be secured. In addition, the sheet onto which the foil has been transferred has to be relocated from the foil transfer apparatus to the printing press. The relocation of the sheet not only requires extra time and work, but also can easily cause mis-register in the processes of foil transferring, printing, and embossing.

SUMMARY OF THE INVENTION

In view of the foregoing circumstances, an object of the present invention is to provide a sheet-fed printing press that is capable of saving the installation space as well as capable of making the operation easier and more efficient. In addition, the present invention provides the sheet-fed printing press that is capable of easily preventing mis-register in the processes of foil transferring, printing, and embossing.

A sheet-fed printing press according to an aspect of the present invention to achieve the above-mentioned objects comprises: a foil transferring portion for transferring foil onto a sheet; a printing portion for performing printing on the sheet; and an embossing portion for giving an embossed finish to the sheet.

A sheet-fed printing press according another aspect of the present invention is the above-described sheet-fed printing press in which the printing portion is disposed at a position located on the downstream side of the foil transferring portion in the transporting direction of the sheet, and located on the upstream side of the embossing portion in the transporting direction of the sheet.

A sheet-fed printing press according another aspect of the present invention is the above-described sheet-fed printing press that further comprises a drying portion for drying the sheet. In addition, in the sheet-fed printing press, the embossing portion is disposed at a position located on the downstream side of both the foil transferring portion and the printing portion in the transporting direction of the sheet. Moreover, the drying portion is disposed at a position located on the downstream side of both the foil transferring portion and the printing portion in the transporting direction of the sheet, and located on the upstream side, in the transporting direction of the sheet, of a position where embossing finish is given to the sheet by the embossing portion.

A sheet-fed printing press according another aspect of the present invention is the above-described sheet-fed printing press that further comprises a heating portion for heating up the sheet. In addition, in the sheet-fed printing press, the heating portion is disposed at a position located on the downstream side of both the foil transferring portion and the printing portion in the transporting direction of the sheet, and located on the upstream side, in the transporting direction of the sheet, of a position where embossing finish is given to the sheet by the embossing portion.

A sheet-fed printing press according another aspect of the present invention is the above-described sheet-fed printing press in which the drying portion includes ultraviolet radiating means for radiating ultraviolet light onto the sheet.

A sheet-fed printing press according another aspect of the present invention is the above-described sheet-fed printing press that further comprises a dry heating portion for drying and heating up the sheet. In addition, in the sheet-fed printing press the embossing portion is disposed at a position located on the downstream side of both the foil transferring portion and the printing portion in the transporting direction of the sheet. Moreover, the dry heating portion is disposed at a position located on the downstream side of both the foil transferring portion and the printing portion in the transporting direction of the sheet, and located on the upstream side, in the transporting direction of the sheet, of a position where embossing finish is given to the sheet by the embossing portion.

A sheet-fed printing press according another aspect of the present invention is the above-described sheet-fed printing press in which the dry heating portion is an ultraviolet radiation lamp for radiating ultraviolet light onto the sheet and for generating heat rays that heat up the sheet.

A sheet-fed printing press according another aspect of the present invention is the above-described sheet-fed printing press that further comprises a coating portion for transferring varnish onto the sheet. In addition, in the sheet-fed printing press the coating portion is disposed at a position located on the downstream side of both the foil transferring portion and the printing portion in the transporting direction of the sheet, and located on the upstream side of the drying portion in the transporting direction of the sheet.

A sheet-fed printing press according another aspect of the present invention is the above-described sheet-fed printing press that further comprises preliminarily drying means for drying ink transferred onto the sheet. In addition, in the sheet-fed printing press, the preliminarily drying means is disposed at a position located on the downstream side, in the transporting direction of the sheet, of a position where the printing is performed on the sheet by the printing portion, and located on the upstream side, in the transporting direction of the sheet, of a position where the varnish is transferred onto the sheet by the coating portion.

A sheet-fed printing press according another aspect of the present invention is the above-described sheet-fed printing press that further comprises cooling means for cooling down the sheet. In addition, in the sheet-fed printing press, the cooling means is disposed at a position located on the downstream side, in the transporting direction of the sheet, of the position where the embossing finish is given to the sheet by the embossing portion.

A sheet-fed printing press according another aspect of the present invention is the above-described sheet-fed printing press in which the embossing portion includes: a counter cylinder supported rotatably and used for holding and transporting the sheet; and a processing cylinder disposed so as to be opposed to the counter cylinder and used so as to work together with the counter cylinder for the purpose of giving embossing finish to the sheet.

A sheet-fed printing press according another aspect of the present invention is the above-described sheet-fed printing press in which the printing portion includes: a plate cylinder; and an impression cylinder having a diameter that is twice as large as the diameter of the plate cylinder. In addition, each of the counter cylinder and the processing cylinder of the embossing portion has a diameter that is equal to the diameter of the plate cylinder.

A sheet-fed printing press according another aspect of the present invention is the above-described sheet-fed printing press in which the foil transferring portion includes: a transport cylinder supported rotatably and used for holding and transporting the sheet; and a press cylinder disposed so as to be opposed to the transport cylinder, supported rotatably, and used for transferring the foil onto the sheet that is held on and transported by the transport cylinder.

A sheet-fed printing press according another aspect of the present invention is the above-described sheet-fed printing press that further comprises: driving means for driving the printing portion and the foil transferring portion; and means for connecting-disconnecting the drive of the press cylinder, the means for connecting and disconnecting the driving, by the driving means, of the press cylinder of the foil transferring portion.

A sheet-fed printing press according another aspect of the present invention is the above-described sheet-fed printing press in which the foil transferring portion includes pressing-cylinder mounting-dismounting means for moving the press cylinder between an operating position, where the press cylinder transfers the foil onto the sheet held on and transported by the transport cylinder, and a retreat position, where the press cylinder is positioned away from the operating position so as to make the foil be not in contact with the sheet.

A sheet-fed printing press—according another aspect of the present invention is the above-described sheet-fed printing press that further comprises an adhesive transferring portion for transferring adhesive onto the sheet. In addition, in the sheet-fed printing press, the adhesive transferring portion is disposed at a position located on the upstream side of the foil transferring portion in the transporting direction of the sheet. Moreover, the foil transferring portion transfers the foil onto a position of the sheet to which position the adhesive has been transferred.

A sheet-fed printing press according another aspect of the present invention is the above-described sheet-fed printing press in which the adhesive transferring portion includes adhesive-temperature regulating means for regulating the temperature of the adhesive that is to be transferred onto the sheet.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

A sheet-fed printing press according to an embodiment of the present invention will be described with reference to FIGS. 1 to 6.

It should be noted that, in the descriptions below, the diameter of each of plate cylinders 44*a* to 44*e* of a printing unit 40 that will be described later is taken as a reference diameter, and a cylinder that has the same diameter as that of each of the plate cylinders 44*a* to 44*e* will be called a "single-sized cylinder." In addition, a cylinder with a diameter that is twice as large as that of each of the plate cylinders 44*a* to 44*e* will be called a "double-sized cylinder."

Figure 1:
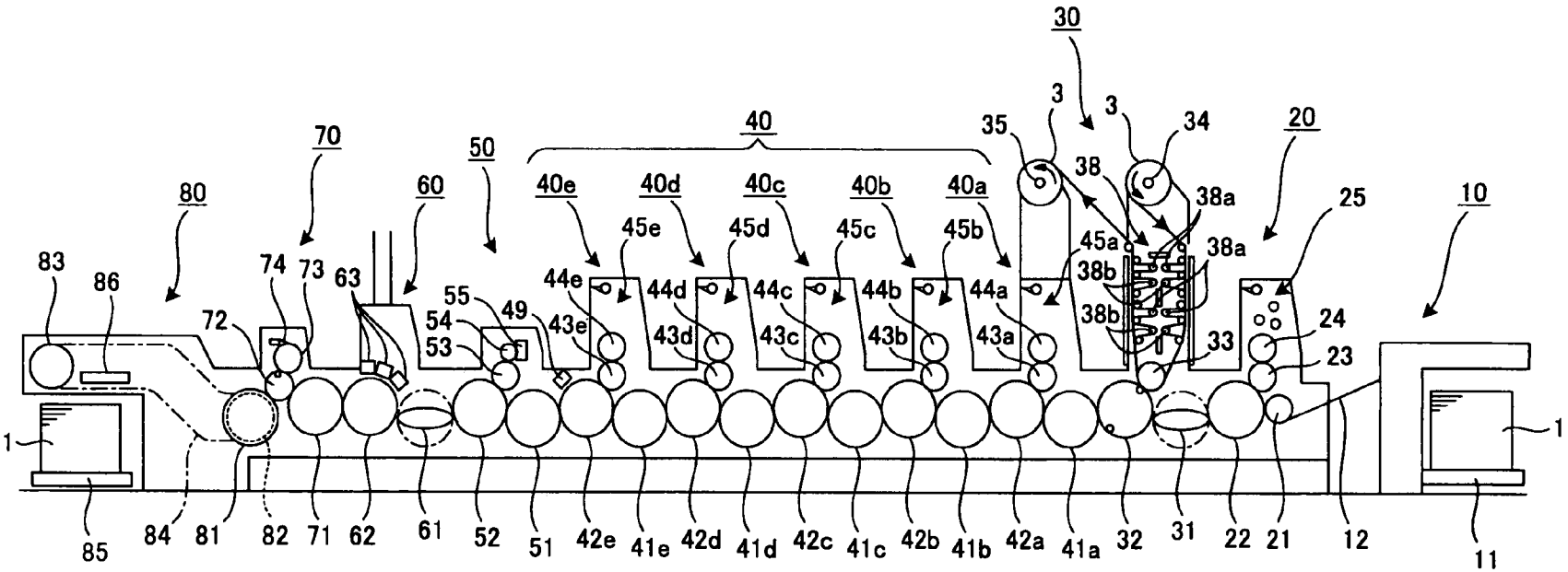
FIG. 1 shows an overall schematic configuration diagram illustrating a sheet-fed printing press according to an embodiment of the present invention.

FIG. 1 shows that a paper feeding apparatus 10 provided with a paper feeding table 11 and with a feeder board 12. The feeder board 12 feeds paper sheets 1, which are sheets stacked on the paper feeding table 11, one by one to a transfer cylinder 21 (single-sized cylinder) of an adhesive transferring unit 20, which is an adhesive transferring portion.

An impression cylinder 22 (double-sized cylinder) is in contact with the transfer cylinder 21 of the adhesive transferring unit 20. A rubber blanket cylinder 23 (single-sized cylinder) is in contact with the impression cylinder 22 at a position on the further downstream side of the impression cylinder 22 in the rotational direction of the impression cylinder 22 than the transfer cylinder 21. A plate cylinder 24 (single-sized cylinder) is in contact with the rubber blanket cylinder 23 at a position on the further upstream side of the rubber blanket cylinder 23 in the rotational direction of the rubber blanket cylinder 23 than the impression cylinder 22.

Figure 2:
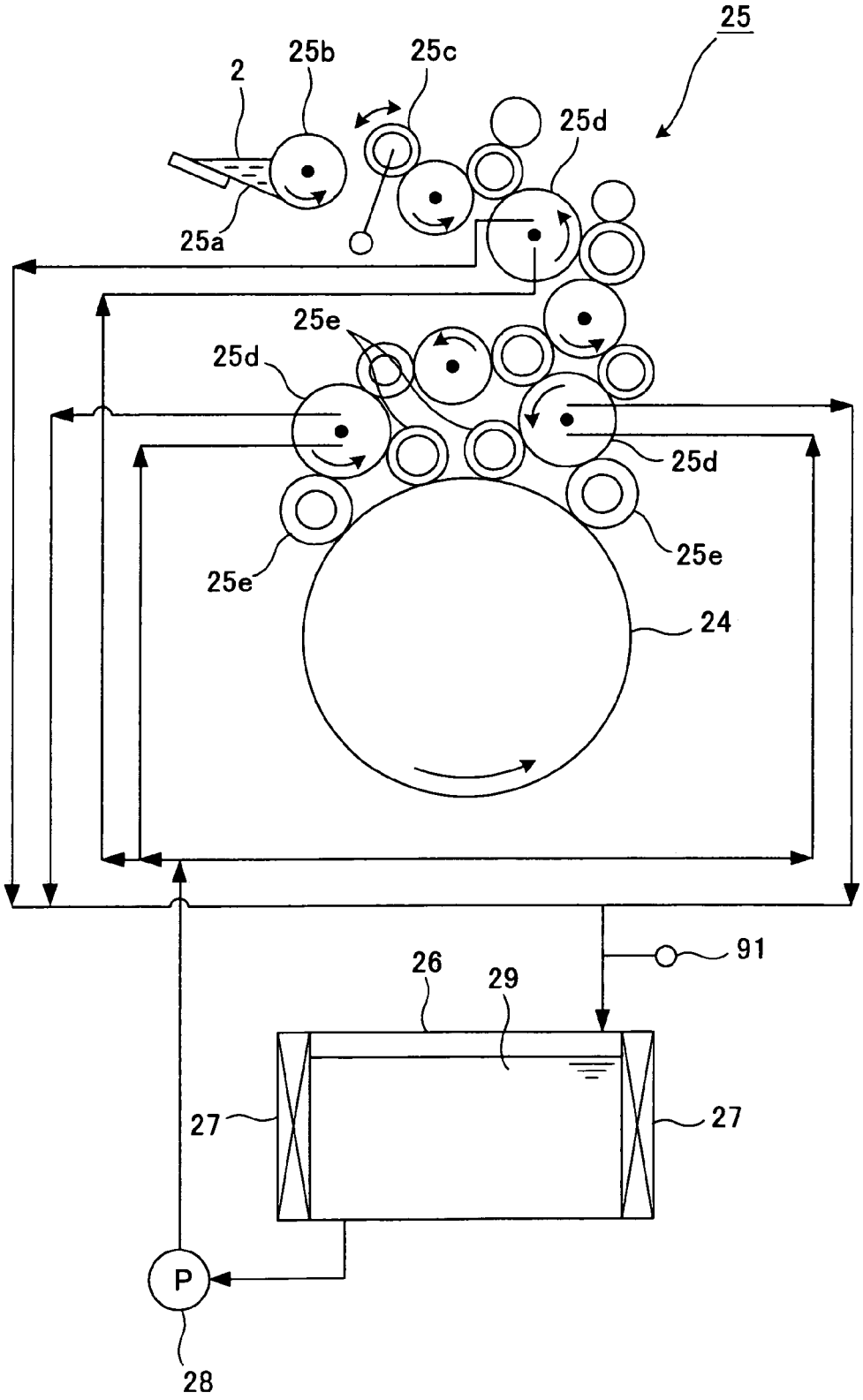
FIG. 2 shows a schematic configuration diagram illustrating an adhesive supply apparatus and an adhesive-temperature adjustment apparatus of an adhesive printing unit shown in FIG. 1.

FIGS. 1 and 2 show that an adhesive supply apparatus 25 is disposed on the further upstream side of the plate cylinder 24 in the rotational direction of the plate cylinder 24 than the rubber blanket cylinder 23. The adhesive supply apparatus 25 is provided with a fountain 25*a* that stores an adhesive 2, a fountain roller 25*b*, ductor rollers 25*c*, oscillating rollers 25*d*, form rollers 25*e*, and the like.

In the adhesive transferring unit 20, the adhesive supply apparatus 25 supplies the adhesive 2 to the plate cylinder 24, and the adhesive 2 is then transferred, with a design formed on the plate cylinder 24, onto the rubber blanket cylinder 23. In this way, the adhesive transferring unit 20 can transfer the adhesive 2 onto the paper sheet 1 supported on the impression cylinder 22.

Inside each of the oscillating rollers 25*d* of the adhesion supply apparatus 25, a channel (not illustrated) is formed to allow a temperature regulating liquid 29 to circulate therethrough. The outlet port of the channel of each oscillating roller 25*d* is connected to the collection port of a tank 26 that is provided with temperature regulators 27. The let-off port of the tank 26 is communicated to the receiving port of a circulating pump 28. The let-off port of the circulating pump 28 is communicated to the inlet port of the channel of each of the oscillating rollers 25*d*.

The temperature of the temperature regulating liquid 29 in the tank 26 is controlled by activating the temperature regulator 27 while the temperature regulating liquid 29 in the tank 26 is circulated through the channels formed in the respective oscillating rollers 25*d* by activating the circulating pump 28. The temperature of the oscillating roller 25*d* is controlled in this way. To this end, a temperature sensor 91 is provided to detect the temperature of the temperature regulating liquid 29 and is shown illustrated in FIG. 2.

In this embodiment, the oscillating rollers 25*d*, the tank 26, the temperature regulators 27, the circulating pump 28, the temperature regulating liquid 29, and the like constitute an adhesive-temperature regulating apparatus, which is adhesive-temperature regulating means for controlling the temperature of the adhesive 2.

Now, refer back to FIG. 1. A transport cylinder 32 (double-sized cylinder) of a cold-foil-transferring unit 30, which is a foil transferring portion, is disposed on further downstream side of the impression cylinder 22 in the rotational direction of the impression cylinder 22 than the transfer position of the adhesive 2 onto the paper sheet 1 by use of the rubber blanket cylinder 23. A skeleton transfer cylinder 31 (double-sized cylinder) is disposed between the impression cylinder 22 and the transport cylinder 32 so as to be in contact with both of the cylinders 22 and 32. In addition, a press cylinder 33 is disposed on a further downstream side of the transport cylinder 32 than the transfer cylinder 31 so as to be opposed to the transport cylinder 32.

A feeder shaft 34 is disposed at a position above the press cylinder 33. The rotatable feeder shaft 34 supports a transfer foil 3, which is wound into a roll shape. The transfer foil 3 is made by forming a layer of foil made of a metal or the like on a remover layer and the like that is formed on a base film made of a resin. Near the feeder shaft 34, a winding shaft 35 is disposed to wind the transfer foil 3. The roll-shaped transfer foil 3 held on the feeder shaft 34 is made to pass through the interstice between the transport cylinder 32 and the press cylinder 33, and then wound on the winding shaft 35.

In the cold-foil-transferring unit 30, the foil is transferred onto the paper sheet 1 onto which the adhesive 2 has been transferred by use of the adhesive transferring unit 20 and which has then been passed to the transport cylinder 32 by the transfer cylinder 31. The transferring of the foil is thus achieved by pressing the transfer foil 3 onto the paper sheet 1 by use of the press cylinder 33. On the paper sheet 1, the foil is transferred only in the portion where the adhesive 2 has been transferred. To put it in other way, the foil is transferred onto the paper sheet 1 so as to correspond to the design of the plate cylinder of the adhesive transferring unit 20.

Figure 3:
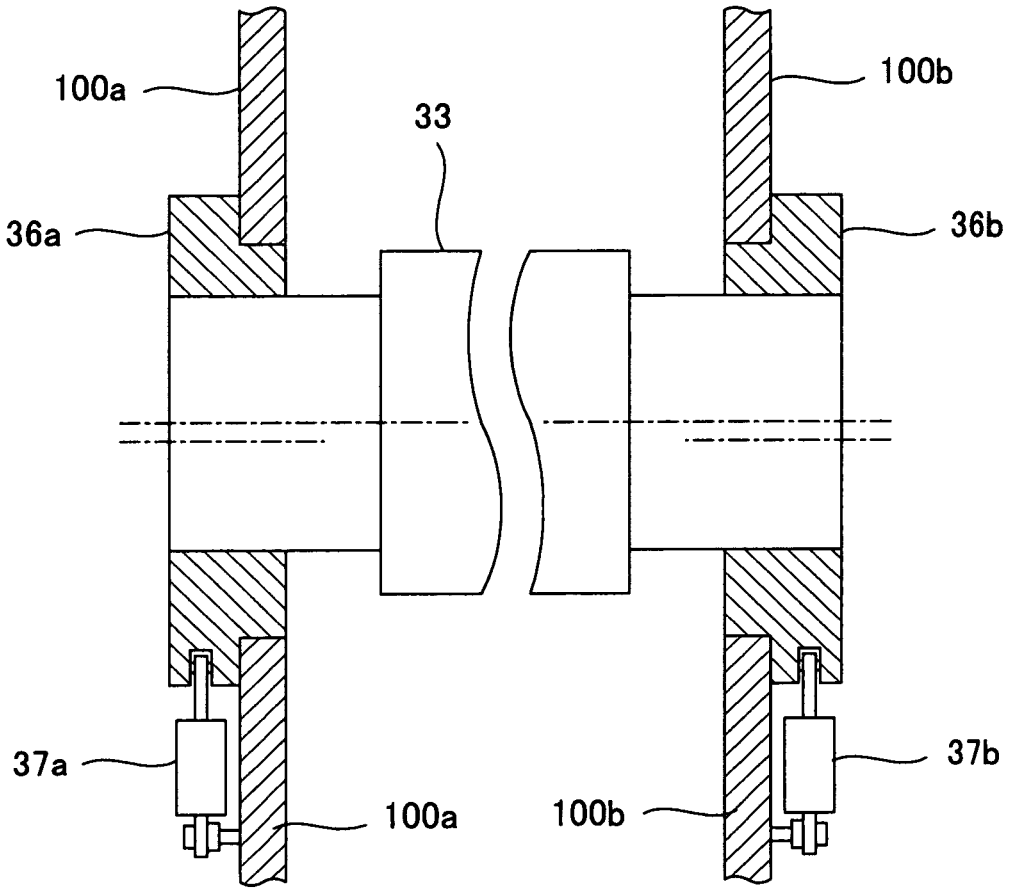
FIG. 3 shows a schematic configuration diagram illustrating a mounting-dismounting mechanism for a press cylinder of a cold foil-transferring unit.

Now, refer to FIG. 3. The two ends of the press cylinder 33 are rotatably supported respectively by eccentric bearings 36*a* and 36*b*. Meanwhile, the eccentric bearings 36*a* and 36*b* are supported respectively by frames 100*a* and 100*b* of this printing press, and allowed to move rotationally. To the eccentric bearings 36*a* and 36*b*, front-end sides of air cylinders 37*a* and 37*b* are respectively connected and are allowed to move rotationally. Meanwhile, the base-end sides of the air cylinders 37*a* and 37*b* are connected respectively to the frames 100*a* and 100*b*.

The telescopic movement of the air cylinders 37*a* and 37*b* makes the eccentric bearings 36*a* and 36*b* move rotationally and relative to the respective frames 100*a* and 100*b*. With this movement of the eccentric bearings 36*a* and 36*b* makes the press cylinder 33 move between the operating position (mounted position)—the position where the press cylinder 33 actually transfers the foil onto the paper sheet 1 held on and transported by the transport cylinder 32—and the retreat position (dismounted position)—a position to which the press cylinder 33 recedes from the operating position so as to prevent the foil from being in contact with the paper sheet 1.

In this embodiment, the eccentric bearings 36*a* and 36*b* as well as the air cylinders 37*a* and 37*b* and the like constitute pressing-cylinder mounting-dismounting means.

Now, refer back to FIG. 1. A foil saving apparatus 38 is disposed so as to be operated in the section between the feeder shaft 34 and the press cylinder 33 as well as in the section between the press cylinder 33 and the winding shaft 35. When guide bars 38*a* move in the right-and-left direction in FIG. 1 (i.e., in the direction perpendicular to the surface of the transfer foil 3), a part of the transfer foil 3 that is traveling in the section between the press cylinder 33 and the transport cylinder 32 is pulled back once. The pulling-back of the transfer foil 3 stops neither the feeding of the transfer foil 3 from the feeder shaft 34 nor the collection of the transfer foil 3 on the winding shaft 35. Accordingly, the part of the transfer foil 3 that would otherwise pass through the above-mentioned section without actually being used for the foil transfer can be used effectively by use of the foil saving apparatus 38 (for more detailed mechanism, see, for example, U.S. Pat. No. 6,334,248 and U.S. Pat. No. 6,491,780). Guide bars 38*b* are also provided so as to be capable of moving in the right-and-left direction in FIG. 1.

An impression cylinder 42*a* (double-sized cylinder) of a first offset printing unit 40*a* of the printing unit 40, which is a printing portion, is disposed on the downstream side of the transport cylinder 32 of the cold foil-transferring unit 30 in the transporting direction of the paper sheet 1, that is, on the further downstream side of the transport cylinder 32 in the rotational direction of the transport cylinder 32 than the foil transfer position where the foil is actually transferred onto the paper sheet 1 by use of the press cylinder 33. A transfer cylinder 41*a* (double-sized cylinder) is disposed between the transport cylinder 32 and the impression cylinder 42*a* so as to be in contact with both of the cylinders 32 and 42*a*. In addition, a rubber blanket cylinder 43*a* (single-sized cylinder) is in contact with the impression cylinder 42*a* at a position on the further downstream side of the impression cylinder 42*a* in the rotational direction of the impression cylinder 42*a* than the reception position where the impression cylinder 42*a* receives the paper sheet 1 from the transfer cylinder 41*a*. Moreover, a plate cylinder 44*a* (single-sized cylinder) is in contact with the rubber blanket cylinder 43*a*.

Figure 4:
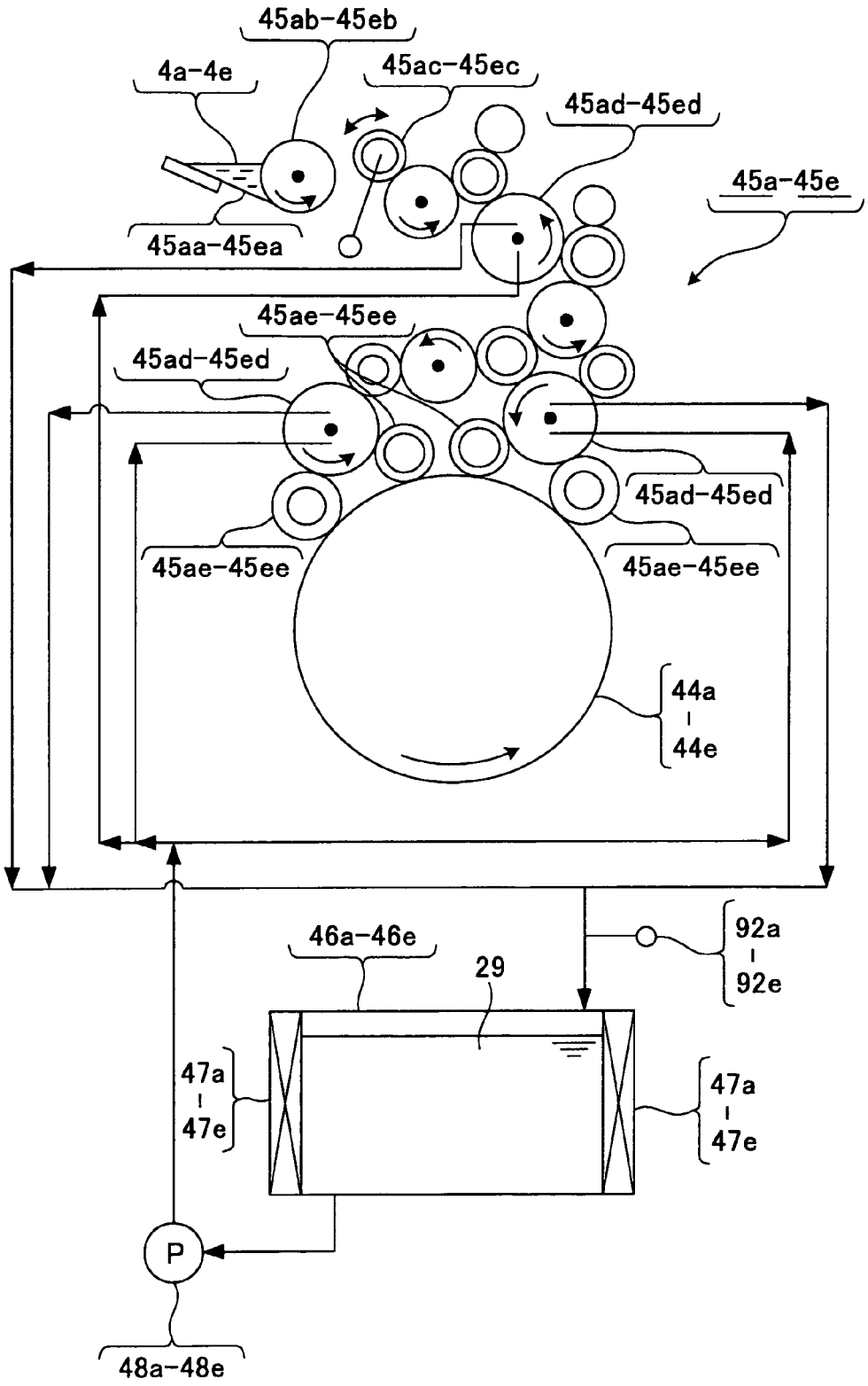
FIG. 4 shows schematic configuration diagram illustrating a first to a fifth ink supply apparatuses and a first to a fifth ink-temperature adjustment apparatuses of a first to a fifth offset printing unit of FIG. 1.

FIGS. 1 and 4 show that the first offset printing unit 40*a* is provided with a first ink supply apparatus 45*a*. The first ink supply apparatus 45*a* includes a fountain 45*aa* that stores a first ink 4*a*, a fountain roller 45*ab*, ductor rollers 45*ac*, oscillating rollers 45*ad*, form rollers 45*ae*, and the like, and supplies ink to the plate cylinder 24.

In the first offset printing unit 40*a*, the first ink supply apparatus 45*a* supplies the first ink 4*a* to the plate cylinder 44*a*, and the ink 4*a* is then transferred, with a design formed on the plate cylinder 44*a*, onto the rubber blanket cylinder 43*a*. In this way, the printing is performed by transferring the ink 4*a* in the first offset printing unit 40*a* onto the paper sheet 1 supported on the impression cylinder 42*a*.

Inside each of the oscillating rollers 45*ad* of the ink supply apparatus 45*a*, a channel (not illustrated) is formed to allow a temperature regulating liquid 29 to circulate therethrough. The outlet port of the channel of each oscillating roller 45*ad* is connected to the collection port of a tank 46*a* that is provided with temperature regulators 47*a*. The let-off port of the tank 46*a* is communicated to the receiving port of a circulating pump 48*a*. The let-off port of the circulating pump 48*a* is communicated to the inlet port of the channel of each of the oscillating rollers 45*ad*.

The temperature of the temperature regulating liquid 29 in the tank 46*a* is controlled by activating the temperature regulators 47*a* while the temperature regulating liquid 29 in the tank 46*a* is circulated through the channels formed in the respective oscillating rollers 45*ad* by activating the circulating pump 48*a*. The temperature of the oscillating roller 45*ad* is controlled in this way. To this end, a temperature sensor 92*a* is provided to detect the temperature of the temperature regulating liquid 29 and is shown illustrated in FIG. 4.

In this embodiment, the oscillating rollers 45*ad*, the tank 46*a*, the temperature regulators 47*a*, the circulating pump 48*a*, the temperature regulating liquid 29, and the like constitute a first ink-temperature regulating apparatus that is provided to control the temperature of the first ink 4*a*.

An impression cylinder 42*b* (double-sized cylinder) of a second offset printing unit 40*b* is disposed on the further downstream side of the impression cylinder 42*a* of the first offset printing unit 40*a* in the rotational direction of the impression cylinder 42*a* than the print position where the printing is actually performed on the paper sheet 1 by use of the rubber blanket cylinder 43*a*. A transfer cylinder 41*b* (double-sized cylinder) is disposed between the impression cylinder 42*a* and the impression cylinder 42*b* so as to be in contact with both of the cylinders 42*a* and 42*b*. In addition, the second offset printing unit 40*b*, as in the case of the first offset printing unit 40*a*, includes a rubber blanket cylinder 43*b* (single-sized cylinder), a plate cylinder 44*b* (single-sized cylinder), and a second ink supply apparatus 45*b* that is provided with a fountain 45*ba*, a fountain roller 45*bb*, ductor rollers 45*bc*, oscillating rollers 45*bd*, form rollers 45*be*, and the like. The second offset printing unit 40*b* also includes a second ink-temperature regulating apparatus and the like. The second ink-temperature regulating apparatus includes the oscillating rollers 45*bd*, a tank 46*b*, temperature regulators 47*b*, a circulating pump 48*b*, the temperature regulating liquid 29, and the like, and controls the temperature of a second ink 4*b*. A temperature sensor 92*b* is also provided and illustrated in FIG. 4.

In addition, an impression cylinder 42*c* (double-sized cylinder) of a third offset printing unit 40*c* is disposed on the further downstream side of the impression cylinder 42*b* of the second offset printing unit 40*b* in the rotational direction of the impression cylinder 42*b* than the print position where the printing is actually performed on the paper sheet 1 by use of the rubber blanket cylinder 43*b*. A transfer cylinder 41*c* (double-sized cylinder) is disposed between the impression cylinder 42*b* and the impression cylinder 42*c* so as to be in contact with both of the cylinders 42*b* and 42*c*. In addition, the third offset printing unit 40*c*, as in the cases of the first and the second offset printing units 40*a* and 40*b*, includes a rubber blanket cylinder 43*c* (single-sized cylinder), a plate cylinder 44*c* (single-sized cylinder), and a third ink supply apparatus 45*c* that is provided with a fountain 45*ca*, a fountain roller 45*cb*, ductor rollers 45*cc*, oscillating rollers 45*cd*, form rollers 45*ce*, and the like. The third offset printing unit 40*c* also includes a third ink-temperature regulating apparatus and the like. The third ink-temperature regulating apparatus includes the oscillating rollers 45*cd*, a tank 46*c*, temperature regulators 47*c*, a circulating pump 48*c*, the temperature regulating liquid 29, and the like, and controls the temperature of a third ink 4*c*. A temperature sensor 92*c* is also provided and illustrated in FIG. 4.

In addition, an impression cylinder 42*d* (double-sized cylinder) of a fourth offset printing unit 40*d* is disposed on the further downstream side of the impression cylinder 42*c* of the third offset printing unit 40*c* in the rotational direction of the impression cylinder 42*c* than the print position where the printing is actually performed on the paper sheet 1 by use of the rubber blanket cylinder 43*c*. A transfer cylinder 41*d* (double-sized cylinder) is disposed between the impression cylinder 42*c* and the impression cylinder 42*d* so as to be in contact with both of the cylinders 42*c* and 42*d*. In addition, the fourth offset printing unit 40*d*, as in the cases of the first to the third offset printing units 40*a* and 40*c*, includes a rubber blanket cylinder 43*d* (single-sized cylinder), a plate cylinder 44*d* (single-sized cylinder), and a fourth ink supply apparatus 45*d* that is provided with a fountain 45*da*, a fountain roller 45*db*, ductor rollers 45*dc*, oscillating rollers 45*dd*, form rollers 45*de*, and the like. The fourth offset printing unit 40*d* also includes a fourth ink-temperature regulating apparatus and the like. The fourth ink-temperature regulating apparatus includes the oscillating rollers 45*dd*, a tank 46*d*, temperature regulators 47*d*, a circulating pump 48*d*, the temperature regulating liquid 29, and the like, and controls the temperature of a fourth ink 4*d*. A temperature sensor 92*d* is also provided and illustrated in FIG. 4.

In addition, an impression cylinder 42*e* (double-sized cylinder) of a fifth offset printing unit 40*e* is disposed on the further downstream side of the impression cylinder 42*d* of the fourth offset printing unit 40*d* in the rotational direction of the impression cylinder 42*d* than the print position where the printing is actually performed on the paper sheet 1 by use of the rubber blanket cylinder 43*d*. A transfer cylinder 41*e* (double-sized cylinder) is disposed between the impression cylinder 42*d* and the impression cylinder 42*e* so as to be in contact with both of the cylinders 42*d* and 42*e*. In addition, the fifth offset printing unit 40*e*, as in the cases of the first to the fourth offset printing units 40*a* and 40*d*, includes a rubber blanket cylinder 43*e* (single-sized cylinder), a plate cylinder 44*e* (single-sized cylinder), and a fifth ink supply apparatus 45*e* that is provided with a fountain 45*ea*, a fountain roller 45*eb*, ductor rollers 45*ec*, oscillating rollers 45*ed*, form rollers 45*ee*, and the like. The fifth offset printing unit 40*e* also includes a fifth ink-temperature regulating apparatus and the like. The fifth ink-temperature regulating apparatus includes the oscillating rollers 45*ed*, a tank 46*e*, temperature regulators 47*e*, a circulating pump 48*e*, the temperature regulating liquid 29, and the like, and controls the temperature of a fifth ink 4*e*. A temperature sensor 92*e* is also provided and illustrated in FIG. 4.

In this embodiment, the first and the fifth ink-temperature regulating apparatuses constitute ink-temperature regulating means.

Now, refer to FIG. 1. An ultraviolet radiation lamp 49 is disposed on the further downstream side of the impression cylinder 42*e* of the fifth offset printing unit 40*e* in the rotational direction of the impression cylinder 42*e* than the rubber blanket cylinder 43*e*, that is, on the downstream side of the print position where the printing is actually performed on the paper sheet 1 by use of the rubber blanket cylinder 43*e* of the printing unit 40*e* in the transporting direction of the paper sheet 1. The ultraviolet radiation lamp 49 is preliminarily drying means that radiates ultraviolet light onto the paper sheet 1. The purposes of the UV-light radiation are to dry (cure) the ink 4*a* to 4*e* (ultraviolet curable ink, or simply, UV-ink) with which the printing is performed on the paper sheet 1 by the printing unit 40 and to dry (cure) the adhesive 2 (ultraviolet curable adhesive, or simply, UV-adhesive) transferred onto the paper sheet 1 by the adhesive transferring unit 20.

A transfer cylinder 51 (double-sized cylinder) is in contact with the impression cylinder 42*e* of the fifth offset printing unit 40*e* at a position on the further downstream side of the impression cylinder 42*e* in the rotational direction of the impression cylinder 42*e* than the preliminary dry position where the adhesive 2 and the inks 4*a* to 4*e* are dried (cured) by radiating UV-light onto the paper sheet 1 by means of the ultraviolet radiation lamp 49. A transport cylinder 52 (double-sized cylinder) of a coating unit 50, which is a coating portion, is in contact with the transfer cylinder 51. A rubber blanket cylinder 53 (single-sized cylinder) is in contact with the transport cylinder 52 at a position further downstream side of the transport cylinder 52 in the rotational direction of the transport cylinder 52 than the transfer cylinder 51. An anilox roller 54 is in contact with the rubber blanket cylinder 53. A coater chamber 55 in which varnish is stored is in contact with the anilox roller 54.

In the coating unit 50, the varnish stored in the coater chamber 55 is taken out by the anilox roller 54, and is then transferred, by means of the rubber blanket cylinder 53, onto the paper sheet 1 held on and transported by the transport cylinder 52.

A skeleton transfer cylinder 61 (double-sized cylinder) is in contact with the transport cylinder 52 of the coating unit 50 at a position on the further downstream side of the transport cylinder 52 in the rotational direction of the transport cylinder 52 than the coating position where the varnish is actually transferred onto the paper sheet 1 by the rubber blanket cylinder 53. A transport cylinder 62 (double-sized cylinder) of a drying unit 60, which is a dry heating portion, is in contact with the transfer cylinder 61. A plurality of ultraviolet radiation lamps 63 is disposed on the further downstream side of the transport cylinder 62 in the rotational direction of the transport cylinder 62 than the reception position where the transport cylinder receives the paper sheet 1 from the transfer cylinder 61. To put it in other way, the contact position is located at a position on the downstream side, in the transporting direction of the paper sheet 1, of the print position where the printing is performed on the paper sheet 1 by the printing unit 40. In other words, the contact position is located at a position on the downstream side, in the transporting direction of the paper sheet 1, of the transfer position where the varnish is transferred onto the paper sheet 1 by the coating unit 50. The ultraviolet radiation lamps 63 together constitute ultraviolet radiating means that dries, ultimately and definitively, the varnish transferred onto the paper sheet 1 and the ink with which the printing is performed on the paper sheet 1 at the end of the series of processes.

In the drying unit 60, UV-light is radiated, by the ultraviolet radiation lamps 63, onto the paper sheet 1 onto which the adhesive 2 has been transferred by the adhesive transferring unit 20, and onto which the varnish (ultraviolet curable varnish (UV-varnish)) has been transferred by the coating unit 50. The radiation of the UV-light dries the adhesive 2 that has been transferred onto the paper sheet 2, the inks 4*a* to 4*e*, and the varnish.

Incidentally, it is certain that the ultraviolet radiation lamps 63 radiate UV-light. Besides, the ultraviolet radiation lamps 63 commonly radiate, to a certain extent, such heat rays as visible light (with a wavelength ranging from 400 nm to 760 nm) and infrared light (with a wavelength longer than 760 nm). Accordingly, the paper sheet 1 that is being dried by the radiation from the ultraviolet radiation lamps 63 of the drying unit 60 is also heated by the heat rays, and the temperature of the paper sheet 1 becomes relatively high (at a range from 35° C. to 40° C., approximately). The temperature of the part onto which the metal foil has been transferred becomes higher (exceeding 40° C.) than the rest of the paper sheet 1.

In this embodiment, the ultraviolet radiation lamps 63 and the drying unit 60 together serve both as a drying portion to dry the paper sheet 1 and as a heating portion to heat the paper sheet 1.

As shown in FIG. 1, a transfer cylinder 71 (double-sized cylinder) is in contact with the transport cylinder 62 of the drying unit 60 at a position on the further downstream side of the transport cylinder 62 in the rotational direction of the transport cylinder 62 than the dry position where the adhesive 2, the inks 4*a* to 4*e*, and the varnish are dried (cured) by the UV-light radiation from the ultraviolet radiation lamps 63 onto the paper sheet 1. In addition, a counter cylinder 72 of an embossing unit 70, which is an embossing portion, is in contact with the transfer cylinder 71. Moreover, a die cylinder 73, which is a processing cylinder, is in contact with the counter cylinder 72 at a position on further downstream side of the counter cylinder 72 in the rotational direction of the counter cylinder 72 than the reception position where the counter cylinder receives the paper sheet 1 from the transfer cylinder 71.

Figure 5:
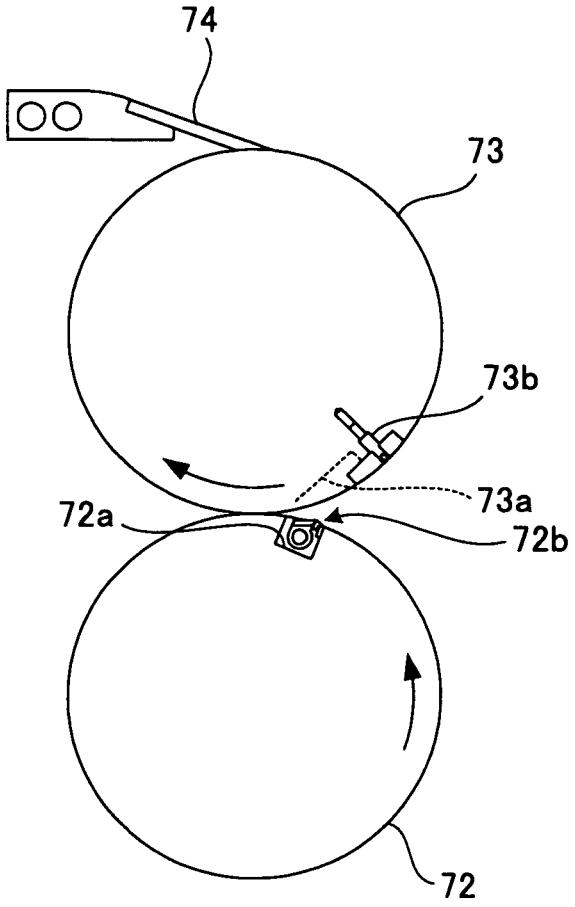
FIG. 5 shows an enlarged diagram illustrated by extracting a principal portion of an embossing unit from FIG. 1.

Now, refer to FIG. 5. A cut-away portion 72*a* is formed in the outer circumferential surface of the counter cylinder 72. A gripper device 72*b* is installed in the cut-away portion 72*a*, and holds the front-end side of the paper sheet 1. The counter cylinder 72 is a single-sized cylinder, and is capable of mounting a raised one of a set of the processing plates on its outer circumferential surface.

In addition, a cut-away portion 73*a* is formed in the outer circumferential surface of the die cylinder 73. The die cylinder 73 is a single-sized cylinder, and is capable of mounting a recessed one of the set of processing plates on its outer circumferential surface by a set of engagement screws 73*b* which are disposed near the cut-away portion 73*a* and which engage with the recessed one of the processing plate.

In the embossing unit 70, the counter cylinder 72 receives, by the gripper device 72*b*, the paper sheet 1 that is passed from the drying unit 60 by means of the transfer cylinder 71. The counter cylinder 72, then, works together with the die cylinder 73 to hold the paper sheet 1 by and between the raised and the recessed plates. The paper sheet 1 is given embossing finish in this way.

In addition, a guide table 74 is provided to guide the plates when the plates are mounted on the respective cylinders 72 and 73, and is illustrated in FIGS. 1 and 5.

Now, refer to FIG. 1. A paper-discharge cylinder 81 (double-sized cylinder) of a paper-discharging apparatus 80, which is a sheet-discharging portion, is in contact with the counter cylinder 72 of the embossing unit 70 at a position on the further downstream side of the counter cylinder 72 in the rotational direction of the counter cylinder 72 than the embossing position where the embossing processing is actually performed on the paper sheet 1 by the die cylinder 73. A sprocket 82 is disposed coaxially with the paper-discharge cylinder 81, and is capable of rotating integrally with the paper-discharge cylinder 81. In addition, the paper-discharging apparatus 80 is provided with a paper-discharge table 85. Moreover, a sprocket 83 is disposed at a position above the paper-discharge table 85. A paper-discharging chain 84 is looped between the sprockets 82 and 83, and a plurality of gripper bars (not illustrated) is attached to the paper-discharging chain 84 at predetermined intervals.

Furthermore, a cooling fan 86, which is cooling means, is disposed between the sprockets 82 and 83, and cools down the paper sheet 1 while the paper sheet 1 is being transported by the paper-discharging chain 84.

Figure 6:
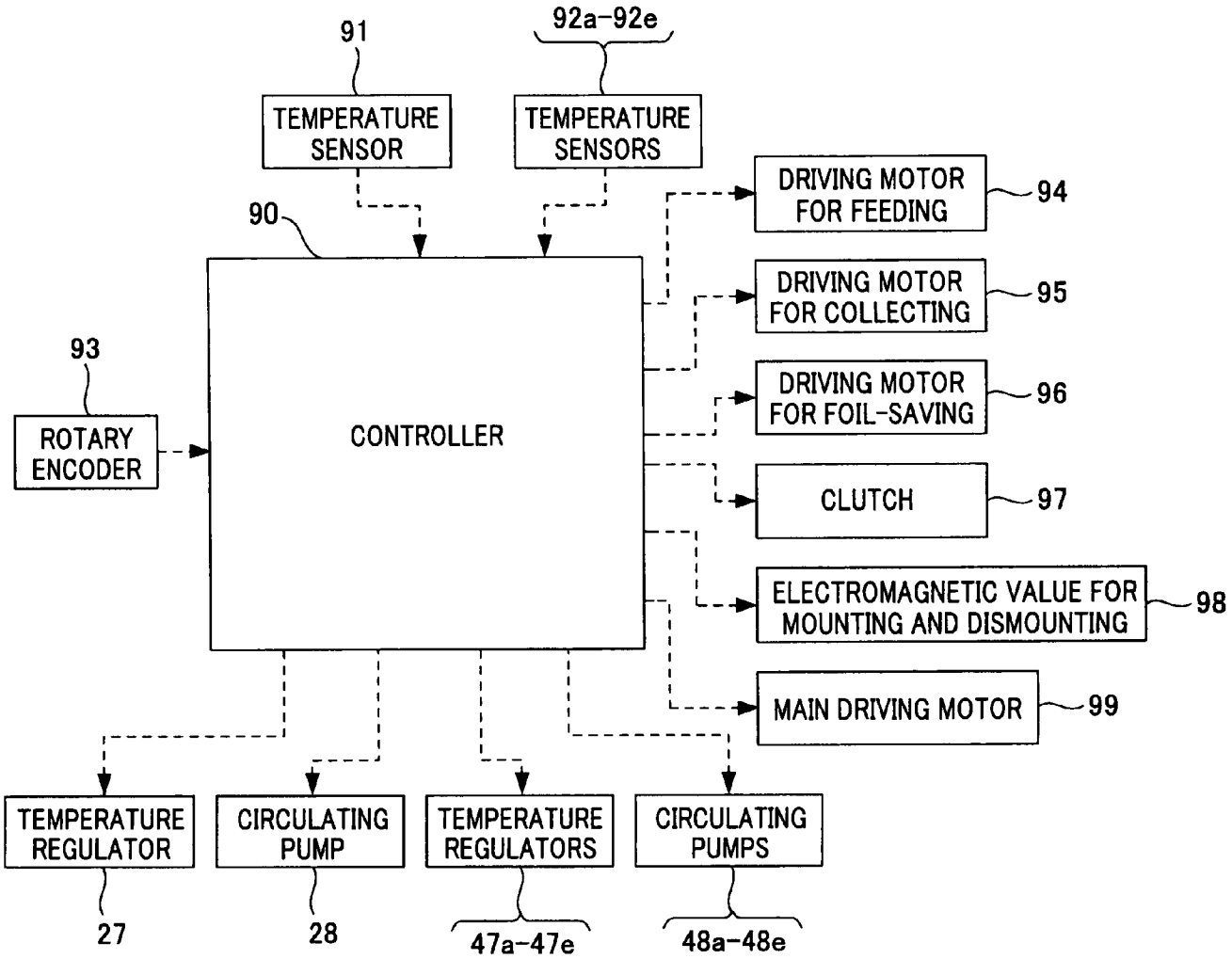
FIG. 6 shows a block diagram showing a principal portion of a controlling system.

Now, refer to FIG. 6. The temperature sensor 91 of the adhesive transferring unit 20 and the temperature sensors 92*a* to 92*e* of the respective printing units 40*a* to 40*e* are electrically connected to the input portion of a controller 90, which is controlling means. The output portion controller 90 is electrically connected to the temperature regulators 27 of the adhesive transferring unit 20 and to the temperature regulators 47*a* to 47*e* of the respective printing unit 40*a* to 40*e*. The output portion controller 90 is also electrically connected to the circulating pump 28 of the adhesive transferring unit 20 and to the circulating pumps 48*a* to 48*e* of the respective printing unit 40*a* to 40*e*. Accordingly, the controller 90 controls the temperature regulators 27 and 47*a* to 47*e* as well as the circulating pumps 28 and 48*a* to 48*e* on the basis of the signals sent from the temperature sensors 91 and 92*a* to 92*e* (detailed descriptions of the control will be given later).

A rotary encoder 93 is connected to the input portion of the controller 90, and detects the rotational phase of the printing press. The output portion of the controller 90 is electrically connected to a main driving motor 99 of the printing press. The main driving motor 99 is driving means for driving a gear train joined together so as to achieve synchronized operations among the adhesive transferring unit 20, the printing unit 40, the coating unit 50, the drying unit 60, the embossing unit 70, the paper-discharging apparatus 80, and the cold foil-transferring unit 30—to be more specific, the transfer cylinder 31, the transport cylinder 32, the press cylinder 33. The output portion of the controller 90 is also electrically connected to a driving motor for feeding 94 that makes the roll-shaped transfer foil 3 travel and be fed from the feeder shaft 34 of the cold foil-transferring unit 30. In addition, the output portion of the controller 90 is electrically connected to a driving motor for collecting 95 that makes the transfer foil 3 travel and be wound on the winding shaft 35 of the cold foil-transferring unit 30. Moreover, output portion of the controller 90 is also electrically connected to a driving motor for foil-saving 96 that moves reciprocally the guide bars 38*a* of the foil saving apparatus 38 of the cold foil-transferring unit 30. Furthermore, output portion of the controller 90 is also electrically connected to a clutch 97, which is means for connecting-disconnecting the drive of the press cylinder. The clutch 97 connects and disconnects the drive of the press cylinder 33 of the cold foil-transferring unit 30 by the main driving motor 99. Yet further,-output portion of the controller 90 is electrically connected to an electromagnetic valve for mounting and dismounting 98 that switches between the air-supply to and air-discharge from the air cylinders 37*a* and 37*b* of the cold foil-transferring unit 30. The controller 90 start and stop the operation of the main driving motor 99 on the basis of the operation-start signal and the operation-stop signal, respectively. The controller 90 controls the driving motors 94 to 96, the clutch 97, and the electromagnetic valve 98 on-the basis of the signals sent from the rotary encoder 93 (detailed descriptions of the control will be given later).

Subsequently, the operation of the sheet-fed printing press according to this embodiment will be described.

At first, the press cylinder 33 of the cold foil-transferring unit 30 is located at the retreat position, where the press cylinder is separated away from the transport cylinder 32. In addition, the clutch 97 is disconnected. Then, with an input of the operation start signal into the controller 90, the controller 90 starts driving to rotate the main driving motor 99. The driving of the main driving motor 99 starts the synchronous operation, by means of the gear train, among the adhesive transferring unit 20, the printing unit 40, the coating unit 50, the drying unit 60, the embossing unit 70, the paper-discharging apparatus 80, and the cold foil-transferring unit 30—to be more specific, the transfer cylinder 31 and the transport cylinder 32. At this time, the paper sheet 1 is fed from the paper feeding apparatus 10.

Subsequently, once the main driving motor 99 is driven to rotate and the rotational speed reaches at a predetermined value, the controller 90 connects the clutch 97 on the basis of a signal sent from the rotary encoder 93. With the connection of the clutch 97, the press cylinder 33 of the cold foil-transferring unit 30 is driven to rotate. In addition, the controller 90, also on the basis of a signal from the rotary encoder 93, controls the electromagnetic valve 98 of the air cylinders 37*a* and 37*b* so that the eccentric bearings 36*a* and 36*b* are made to move rotationally. With the rotational movement of the eccentric bearings 36*a* and 36*b*, the press cylinder 33 becomes located at the operating position, that is, the press cylinder 33 is brought into contact with the transport cylinder 32. Moreover, the controller 90 actuates the driving motors 94 to 96 so that the transfer foil 3 can be fed, the foil can be transferred, the transfer foil 3 can be collected, and the foil saving can be performed.

To be more specific, firstly, once the paper sheet 1 is passed from the paper feeding apparatus 10 to the transfer cylinder 21 and then from the transfer cylinder 21 to the impression cylinder 22 of the adhesive transferring unit 20, the adhesive transferring unit 20 supplies the adhesive 2 from the adhesive supply apparatus 25 to the plate cylinder 24 in the way described above. The adhesive 2 is then transferred onto the rubber blanket cylinder 23 so as to form the design corresponding to the one formed in the plate cylinder 24. The adhesive 2 is thus transferred onto the paper sheet 1 supported on the impression cylinder 22.

The paper sheet 1 onto which the adhesive 2 has been transferred is then passed from the impression cylinder 22 to the transfer cylinder 31 and then from the transfer cylinder 31 to the transport cylinder 32 of the cold foil-transferring unit 30. As described above, in the cold foil-transferring unit 30, the press cylinder 33 presses the transfer foil 3 onto the paper sheet 1, and thus the foil of the transfer foil 3 is transferred exclusively to the part of the paper sheet 1 onto which part the adhesive 2 has been transferred. In this way, the foil is transferred onto the paper sheet 1 so as to correspond to the design formed in the plate cylinder 24 of the adhesive transferring unit 20.

In this event, the foil saving apparatus 38 of the cold foil-transferring unit 30 operates in such a way as described above. Accordingly, the transfer foil 3 is not wasted but is effectively used (for more specific operation of the foil saving apparatus 38, see U.S. Pat. No. 6,334,248 and U.S. Pat. No. 6,491,780).

Once the foil is transferred onto the paper sheet 1, the paper sheet 1 is fed to the first and the fifth offset printing unit successively, where the printing is performed on the paper sheet 1. To put it in other way, the first and the fifth inks 4*a* to 4*e* are successively transferred onto the paper sheet 1.

Once the printing with inks 4*a* and 4*e* are performed on the paper sheet 1 including on top of the transferred foil, the paper sheet 1 is passed from the impression cylinder 42*e* of the fifth offset printing unit 40*e* to the transfer cylinder 51 and then from the transfer cylinder 51 to the transport cylinder 52 of the coating unit 50. Before the paper sheet 1 is fed to the coating unit 50, the adhesive 2 and the inks 4*a* to 4*e* on the paper sheet 1 are cured (dried) by the ultraviolet radiation lamp 49.

As described above, in the coating unit 50, the varnish stored in the coater chamber 55 is taken out by the anilox roller 54, and is then transferred onto the paper sheet 1 by the rubber blanket cylinder 53.

Once the varnish is transferred onto the paper sheet 1, the paper sheet 1 is then passed from the transport cylinder 52 to the transfer cylinder 61 and then from the transfer cylinder 61 to the transport cylinder 62 of the drying unit 60. As described above, in the drying unit 60, UV-light is radiated from the ultraviolet radiation lamps 63, and thereby the adhesive 2, the inks 4*a* to 4*e*, and the varnish that have been transferred onto the paper sheet 1 are ultimately and definitively cured (dried) at the end of the series of processes. In addition, the paper sheet 1 is heated by the heat rays emitted from the ultraviolet radiation lamps 63 along with the radiation of the UV-light. The temperature of the paper sheet 1 thus heated rises up to a relatively high temperature (in a range from 35° C. to 40° C., approximately). At this time, the temperature of the portion of the paper sheet 1 onto which portion the metal foil of has been transferred rises up to a still higher temperature (exceeding 40° C.).

Once the inks 4*a* to 4*e* and the varnish are dried and the paper sheet 1 is heated, the paper sheet 1 is passed from the transport cylinder 62 to the transfer cylinder 71 and then from the transfer cylinder 71 to the counter cylinder of the embossing unit 70. As described above, in the embossing unit 70, the raised plate on the counter cylinder 72 and the recessed plate on the die cylinder 73 work together to hold the paper sheet 1 in between. Thus, the paper sheet 1 is given an embossed finish.

While the embossing process is being performed on the paper sheet 1, the paper sheet 1, still heated, is kept at a relatively high temperature (in a range from 35° C. to 40° C., approximately; particularly, the foil-transferred portion at a still higher temperature above 40° C.). In this state, the paper sheet 1 has a low elastic recovery force. Accordingly, the raised and recessed shape formed by the embossing is more likely to be kept as it is, and the embossing process is performed with higher precision.

The paper sheet 1 with the embossing finish is passed from the counter cylinder 72 to the paper-discharge cylinder 81 of the paper-discharging apparatus 80 and then from the paper-discharge cylinder 81 to the grippers of gripper bars on the paper-discharging chain 84. The transporting of the paper sheet 1 is thus kept on to the final stage. The paper sheet 1 is cooled down by the cooling fan 86, and is then discharged to the top of the paper-discharge table 85. A stack of paper sheets 1 thus discharged successively is formed on the paper-discharge table 85.

With these processed described thus far, the foil is transferred onto the paper sheet 1, the inks 4*a* to 4*e* are printed on the paper sheet 1, and embossing finish is given to the paper sheet 1.

While the printing press is in operation as described above, the controller 90 controls the temperature regulators 27 and 47*a* to 47*e*, as well as the circulating pumps 28 and 48*a* to 48*e* on the basis of the signals sent from the temperature sensor 91 of the adhesive transferring unit 20 and from the temperature sensors 92*a* to 92*e* of the respective printing units 40*a* to 40*e*. With this control, the temperature regulating liquid flowing in the adhesive transferring unit 20 is kept at a predetermined temperature, so are the temperature regulating liquids flowing in the respective printing units 40*a* to 40*e*. The temperature of the adhesive 2 at the time of its transfer onto the paper sheet 1, and the temperature of each of the inks 4*a* to 4*e* at the time of printing on the paper sheet 1 are controlled in this way.

Now, suppose that the feeding of the paper sheets 1 from the paper feeding apparatus 10 is stopped and that an operation-stop signal is inputted into the controller 90. Then, the controller 90 reduces the speed of the main driving motor 99 having been driven to rotate, so as to stop the operation of the adhesive transferring unit 20, the printing unit 40, the coating unit 50, the drying unit 60, the embossing unit 70, the paper-discharging apparatus 80, and the cold foil-transferring unit 30—to be more specific, the transfer cylinder 31 and the transport cylinder 32.

Subsequently, the controller 90, on the basis of the signals sent from the rotary encoder 93 performs the following controls. The clutch 97 is disconnected so as to stop the rotation of the press cylinder 33 of the cold foil-transferring unit 30. The electromagnetic valve 98 of the air cylinders 37*a* and 37*b* is controlled so that the eccentric bearings 36*a* and 36*b* can move rotationally. With the rotational movement, the press cylinder 33 is separated away from the transport cylinder 32, and is made to recede to the retreat position. In addition, the driving motors 94 to 96 are controlled stop operation. Thereby, the transfer of the foil of the transfer foil 3 onto the paper sheet 1 is stopped. Moreover, the main driving motor 99 stops operation. In this moment, the printing is terminated and the operation of the machine is stopped.

In summary, according to this embodiment, all of the processes including the transfer of the foil, the transfer of the inks 4*a* to 4*e*, and the embossing are performed with a single pass of the paper. To put it in other way, all of these processes are performed in the period beginning from the time when the paper sheet 1 is fed from the paper feeding apparatus 10 and ending at the time when the paper sheet 1 is discharged to the paper-discharging apparatus 80.

Accordingly, it is no longer necessary to use a foil transfer apparatus and a printing press provided separately. As a result, securing the space for the installation becomes easier. The paper sheet 1 onto which the foil has been transferred does not have to be moved from the foil transfer apparatus to the printing press. Thus, the operation as a whole becomes easier and more efficient. Additionally, the mis-register in the processes of foil transferring, printing, and embossing can be easily prevented.

As a result, the use of the sheet-fed printing press according to this embodiment contributes to the achievement of space-saving, an easier and more efficient operation, and easy prevention of the mis-register in the processes of foil transferring, printing, and embossing. Besides, the following effects can be obtained as well.

(1) The adhesive 2 is made to adhere more stably, and the inks 4*a* to 4*e* become more suitable for use in printing. In addition, these are accomplished with ease by the control, which is now possible, of the temperature of the adhesive 2 in the adhesive transferring unit 20 and the temperature of the each of the inks 4*a* to 4*e* in the respective printing units 40*a* to 40*e*.

(2) The expensive foil is prevented from being wastefully consumed during the preparatory operation. This is accomplished by the clutch 97 that switches between the state where the driving power of the main driving motor 99 is allowed to be transmitted to the press cylinder 33 of the cold foil-transferring unit 30 and the state where the transmission of the driving power is blocked. In addition, the movement of the press cylinder 33, which is now possible, from the operating position to the retreat position, and vice versa is another contributing factor to the above-mentioned accomplishment.

(3) The transferring of the varnish onto the paper sheet 1 is preceded by the drying (curing) of the inks 4*a* to 4*e* and the adhesive 2. This is accomplished by the ultraviolet radiation lamps 63 disposed at a position located on the downstream side, in the transporting direction of the paper sheet 1, of the position where the printing is performed on the paper sheet 1 by means of the printing unit 40. That location of the ultraviolet radiation lamps 63 is, at the same time, on the upstream side, in the transporting direction of the paper sheet 1, of the position where the varnish is transferred onto the paper sheet 1 by means of the coating unit 50.

(4) The foil becomes brighter and the inks 4*a* and 4*e* become glossier. These are accomplished by the coating unit 50 disposed at a position located on the downstream side, in the transporting direction of the paper sheet 1, of both the cold foil-transferring unit 30 and the printing unit 40. That location of the coating unit 50 is, at the same time, on the upstream side, in the transporting direction of the paper sheet 1, of the drying unit 60. Another effect obtainable from such a location of the coating unit 60 is the prevention of the damage which would be otherwise done on the foil and the like due to the grazing at the time of embossing. This effect is accomplished directly by the protective coat of the varnish formed on the paper sheet 1 before the embossing.

(5) It is easier to keep the raised and recessed shape formed by the embossing as it was originally formed. This is accomplished, as described above, the simultaneous drying and heating of the paper sheet 1, which are now made possible by the drying unit 60 provided with the ultraviolet radiation lamps 63 and disposed at a position on the downstream side, in the transporting direction of the paper sheet 1, of the cold foil-transferring unit 30 and the printing unit 40. That location of the drying unit 60 is, at the same time, on the upstream side, in the transporting direction of the paper sheet 1, of the position where the embossing is performed on the paper sheet 1 by means of the embossing unit 70. With the location of such a drying unit 60, it is not necessary to provide an apparatus dedicated exclusively to the heating of the paper sheet 1. This brings about such effects as further space saving and lower costs.

(6) It is easier to match the phase of the plate on the die cylinder 74 with the phase of the plate on the counter cylinder 72. The time needed for the preparation is shortened, and the waste sheets produced from the embossing are reduced. These are accomplished by the following configuration according to this embodiment. Each of the plate cylinders 44*a* to 44*e* of the printing unit 40 is a single-sized cylinder (a cylinder of a diameter allowing only one plate to be supported on the outer circumferential surface of the cylinder). Each of the impression cylinders 42*a* to 44*e* is a double-sized cylinder (a cylinder of a diameter allowing two paper sheets 1 to be supported on the outer circumferential surface of the cylinder and allowing two sets of a cut-away portion and a gripper device to be provided for this purpose). In spite of these diameters of the above-mentioned cylinders, both the counter cylinder 72 of the embossing unit 70 and the die cylinder are single-sized cylinders. Here, the counter cylinder 72 has a diameter allowing a single paper sheet 1 and a single set of plates corresponding to the single paper sheet 1 to be supported on the outer circumferential surface of the counter cylinder 72 and allowing only a single set of a cut-away portion 72*a* and a gripper device 72*b* as well as only a single set of members for supporting the plates to be provided for this purpose. The die cylinder has a diameter allowing only a single set of plates corresponding to a single paper sheet 1 to be supported on the outer circumferential surface of the die cylinder 73 and allowing only a single set of the cut-away portion 73*a* and the engagement screw 73*b* to be provided for this purpose.

(7) The paper sheet 1 that has been heated up by means of the ultraviolet radiation lamps 63 of the drying unit 60 is cooled down before the paper sheet 1 is discharged to the paper-discharge table 85 of the paper-discharging apparatus 80. This is accomplished by the cooling fan 86 disposed at a position located on the downstream side, in the transporting direction of the paper sheet 1, of the position where the embossing is performed on the paper sheet 1 by means of the embossing unit 70.

Incidentally, in this embodiment, the drying unit 60 equipped with the ultraviolet radiation lamps 63 constitutes a dry heating portion that serves both as a drying portion to dry the paper sheet 1 and as a heating portion to heat the paper sheet 1 up. In a possible alternative embodiment, a drying portion to dry a sheet and a heating portion to heat the sheet up are provided individually and independently of each other.

In addition, in this embodiment, the controller 90 controls the switching of the connection and disconnection of the clutch 97. This is not the only possible way of the switching control for the present invention. For example, the connection and the disconnection of the clutch can be switched manually by an operator. Note that, in this case, the connection and the disconnection of the clutch has to be done while the machine is not in operation.

Moreover, the descriptions given in this embodiment are based on a case where the cold foil-transferring unit 30 is employed to serve as a foil transferring portion. In a possible alternative embodiment, a hot foil-stamping unit is employed to serve as the foil transferring portion.

Incidentally, in the case where the cold foil-transferring unit 30 is employed to serve as the foil transferring portion, the transferring of the foil onto the paper sheet 1 has to be carried out with the adhesive 2 having been transferred onto the paper sheet 1 by means of the adhesive transferring unit 20 disposed at a position on the upstream side of the cold foil-transferring unit 30 in the transporting direction of the paper sheet 1. In contrast, the hot foil-stamping unit transfers the foil of a transfer foil having an adhesive layer onto a sheet by the adhesive layer. For this purpose, the transfer foil is pressed onto the sheet by a press cylinder provided with a pressing die that has a raised design formed in its outer circumferential surface. The pressing die is heated at the time of the foil transfer.

Accordingly, when the hot foil-stamping unit replaces the cold foil-transferring unit to serve as the foil transferring portion, the adhesive transferring unit such as one described above becomes unnecessary. For this reason, the adhesive stored in the fountain of the adhesive supply apparatus in the adhesive transferring unit can be replaced by an ink and the adhesive transferring unit can be used as another offset printing unit. The use of such an offset printing unit allows the transfer of ink to be performed not only after the transferring of the foil onto the sheet but also before that. As a consequence, printing of greater variety can be performed on the sheet. Here, needless to say, the fountain of the adhesive supply apparatus of the adhesive transferring unit can be left empty with no ink being stored therein, and no printing is performed before the transferring of the foil onto the sheet.

When the adhesive transferring unit is used as an offset printing unit, the difference in the viscosity between the adhesive and the ink has to be taken care of by any means. For example, in a preferable configuration, the kind of liquid (adhesive or ink) stored in the fountain of the adhesive supply apparatus of the adhesive transferring unit is made selectable by the controller. In addition, with the selection, the controller switches the temperature set for the adhesive-temperature regulating means of the adhesive transferring unit between the temperature range appropriate for the transferring of the adhesive onto the sheet and the temperature range appropriate for the printing with ink on the sheet. In a more preferable configuration, fine tuning of the temperature range thus set can be done by an input manually performed by an operator.

The sheet-fed printing press according to the present invention is to provide capable of performing the transferring of foil, the printing, and the embossing on a sheet without employing individually a foil transfer apparatus and a printing press. Accordingly, it becomes easier to secure the installation space for an apparatus that performs the transferring of foil, the printing, and the embossing on a sheet. In addition, by use of the printing press, all the processes mentioned above can be completed by only a single pass of the sheet through the printing press. Thus, the sheet onto which the foil has been transferred does not have to be relocated from the foil transfer apparatus to the printing press, so that the operation becomes easier and more efficient. Additionally, the mis-register in the processes of foil transferring, printing, and embossing can be easily prevented.

The sheet-fed printing press according to the present invention is capable of performing the foil transferring, the printing, and the embossing on a sheet without using a foil transfer apparatus and a printing press that are provided independently. For this reason, the printing press according to the present invention is extremely useful in the printing industry and the like.

The invention thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A sheet-fed printing press, comprising:

a foil transferring portion for transferring foil onto a sheet;

a printing portion for performing printing on the sheet;

an embossing portion for giving an embossed finish to the sheet; and a dry heating portion configured to dry and heat up the sheet, such that a temperature of the foil transferred onto the sheet exceeds 40° C. to lower an elastic recovery force of the sheet, such that raised and recessed shape formed by the embossing portion are maintained, wherein the embossing portion is disposed at a position located on a downstream side of both the foil transferring portion and the printing portion in a transporting direction of the sheet, and the dry heating portion is disposed at a position located on the downstream side of both the foil transferring portion and the printing portion in the transporting direction of the sheet, and located on an upstream side, in the transporting direction of the sheet, of a position where embossing finish is given to the sheet by the embossing portion, wherein the printing portion is disposed at a position located on the downstream side of the foil transferring portion in the transporting direction of the sheet, and located on the upstream side of the embossing portion in the transporting direction of the sheet, wherein the embossing portion includes:

a counter cylinder supported rotatably and used for holding and transporting the sheet; and a processing cylinder disposed so as to be opposed to the counter cylinder and used for working together with the counter cylinder to give embossing finish to the sheet, and wherein the foil transferring portion includes:

a transport cylinder supported rotatably and used for holding and transporting the sheet; and a press cylinder disposed so as to be opposed to the transport cylinder, supported rotatably, and used for transferring the foil onto the sheet that is held on and transported by the transport cylinder, and the sheet-fed printing press, further comprising:

driving means for driving the printing portion and the foil transferring portion; and means for connecting-disconnecting a drive of the press cylinder, the means for connecting and disconnecting the driving, by the driving means, of the press cylinder of the foil transferring portion, wherein the foil transferring portion includes pressing-cylinder mounting-dismounting means for moving the press cylinder between an operating position, where the press cylinder transfers the foil onto the sheet held on and transported by the transport cylinder, and a retreat position, where the press cylinder is positioned away from the operating position so as to make the foil be not in contact with the sheet.

2. The sheet-fed printing press according to claim 1, wherein the dry heating portion is an ultraviolet radiation lamp for radiating ultraviolet light onto the sheet and for generating heat rays that heat up the sheet.

3. The sheet-fed printing press according to claim 1, further comprising:

a coating portion for transferring varnish onto the sheet, wherein the coating portion is disposed at a position located on the downstream side of both the foil transferring portion and the printing portion in the transporting direction of the sheet, and located on the upstream side of the dry heating portion in the transporting direction of the sheet.

4. The sheet-fed printing press according to claim 3, further comprising:

preliminarily drying means for drying ink transferred onto the sheet, wherein the preliminarily drying means is disposed at a position located on the downstream side, in the transporting direction of the sheet, of a position where the printing is performed on the sheet by the printing portion, and located on the upstream side, in the transporting direction of the sheet, of a position where the varnish is transferred onto the sheet by the coating portion.

5. The sheet-fed printing press according to claim 1, further comprising:

cooling means for cooling down the sheet, wherein the cooling means is disposed at a position located on the downstream side, in the transporting direction of the sheet, of the position where the embossing finish is given to the sheet by the embossing portion.

6. The sheet-fed printing press according to claim 1, wherein the printing portion includes:

a plate cylinder; and an impression cylinder having a diameter that is twice as large as a diameter of the plate cylinder, and each of the counter cylinder and the processing cylinder of the embossing portion has a diameter that is equal to the diameter of the plate cylinder.

7. The sheet-fed printing press according to claim 1, further comprising:

an adhesive transferring portion for transferring adhesive onto the sheet, wherein the adhesive transferring portion is disposed at a position located on the upstream side of the foil transferring portion in the transporting direction of the sheet, and the foil transferring portion transfers the foil at a position to which the adhesive has been transferred on the sheet.

8. The sheet-fed printing press according to claim 7, wherein the adhesive transferring portion includes adhesive-temperature regulating means for regulating a temperature of the adhesive that is to be transferred onto the sheet.

9. The sheet-fed printing press according to claim 1, wherein the dry heating portion heats the sheet to 35 to 40° C.

* * * * *